US006584042B1

(12) United States Patent
Serafini et al.

(10) Patent No.: US 6,584,042 B1
(45) Date of Patent: Jun. 24, 2003

(54) CLOCK STRUCTURE

(76) Inventors: Alma C. Serafini, 1620 Valle Vista Ave., #150, Vallejo, CA (US) 94589; Stanley W. Serafini, 1620 Valle Vista Ave., #150, Vallejo, CA (US) 94589

( * ) Notice: Subject to any disclaimer, the term of this patent is extended or adjusted under 35 U.S.C. 154(b) by 0 days.

(21) Appl. No.: 10/125,124

(22) Filed: Apr. 16, 2002

(51) Int. Cl.[7] ..... G04B 37/00; G04C 23/02
(52) U.S. Cl. ..... 368/88; 368/276; 368/316
(58) Field of Search ..... 368/88, 276, 277, 368/278, 309, 316–317

(56) References Cited

U.S. PATENT DOCUMENTS 3,807,236 A * 4/1974 Leone ..... 73/431
4,506,993 A * 3/1985 Brown ..... 368/314
5,036,501 A * 7/1991 Smith ..... 368/8

* cited by examiner

*Primary Examiner*—Vit Miska

(57) ABSTRACT

A clock structure mountable to a corner of an edifice utilizing a case. The case includes a pair of walls which closely match the orientation of the corner walls of the edifice. In addition, two wall portions extend outwardly from the corner matching walls of the clock structure to provide recesses on either side of the facade of the clock structure. A door is hingedly attached to the case and at least partially enters the recess formed by the walls of the clock structure. Likewise, a latching mechanism is located in the opposite recess and is readily accessible.

8 Claims, 2 Drawing Sheets

CLOCK STRUCTURE

BACKGROUND OF THE INVENTION

The present invention relates to a novel and useful clock structure mountable to a corner area of an edifice.

Clocks often are set on vertical surfaces to permit occupants of a room to ascertain the time from various positions in the room. In most cases, the clock is mounted to a single wall which is generally vertical in orientation.

A problem exists where a clock must be mounted to the corner of a room involving a pair of walls angularly disposed to one another. In the past, auxiliary structure have been employed to mount a clock to a corner position in a room. For example, brackets, shelves, cables, and the like have been employed in this regard. However, such mounting fixtures are normally unwieldy and do not permit the clock to be snugly positioned in a corner of a room.

A clock structure which is mountable to first and second corner walls of an edifice would be a notable advance in the field of household goods and the decorative arts.

BRIEF SUMMARY OF THE INVENTION

In accordance with the present invention a novel and useful clock structure mountable to a corner of an edifice is herein provided.

The clock structure of the present invention utilizes a case. The case possesses a first wall and a second wall which is angularly affixed to the first wall. The first and second walls, forming a corner, closely match the orientation of the first and second corner walls of an edifice such as a home or office. The clock includes a top and bottom which is normally horizontal and parallel to the floor of the edifice.

A third wall is connected to the first wall and extends outwardly therefrom to form a first recess adjacent the first wall of the edifice. Likewise, a fourth wall connected to the case second wall extends outwardly from the second wall and the corner wall of the edifice to form a second recess. In cross-section, the case may take the form of a regular or irregular pentagon.

A door is also included in the present structure and may be hingedly attached to the third case wall. Upon rotation, the door extends into the first recess and may swing freely to allow one to affect repairs to the clock structure within the case. In this regard, the door and case form a chamber within the case and which may be employed to contain a time keeping mechanism or to store items. It should be noted that the time keeping mechanism may also be affixed to a surface of the swinging door within the chamber. The time keeping mechanism is linked to the hands of the clock by extending a portion through the door to the outside of the chamber. The hands are clearly visible to the occupants of a room.

The structure of the present invention may further include a latch mechanism which is affixed to the fourth case wall and lies within the second recess. A strike may be connected to the swinging door and rotate into the second recess for engagement with the latch.

In addition, means is also provided for fixing the case to either the first or second corner walls of the edifice. Provision is made for fasteners which extend through the first or second case walls of the structure in order to engage structural members found along the first and second corner walls of the edifice. Namely, studs in the vicinity of the corner formed by the first and second corner walls of the edifice may be used in this regard. openings are provided in the case to allow such fasteners to be aligned as needed to engage support members near the corner walls of the edifice.

It may be apparent that a novel and useful clock structure has been hereinabove described.

It is therefore and object of the present invention to provide a clock structure mountable to corner walls of an edifice which fits snuggly in the corner of the edifice and is easily affixed to structural members forming the first and second corner walls of the edifice.

Another object of the present invention is to provide a clock structure mountable the corner walls of an edifice which includes a door that is freely rotatable relative to the case of the clock structure without interference.

Yet another object of the present invention is to provide a clock structure mountable to the corner walls of an edifice which is compact in configuration and fully operational when placed in position in the corner of the edifice.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be taken in conjunction with the prior delineated drawings.

Figure 1:
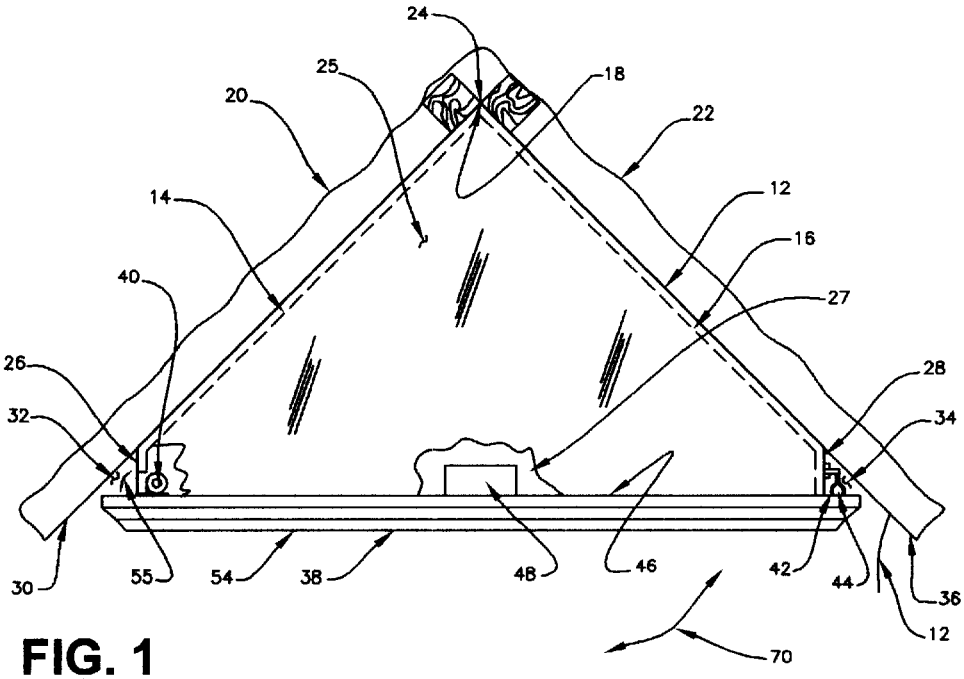
FIG. 1 is a top plan view of the clock structure of the present invention depicting a corner wall of an edifice partially in section.
Figure 2:
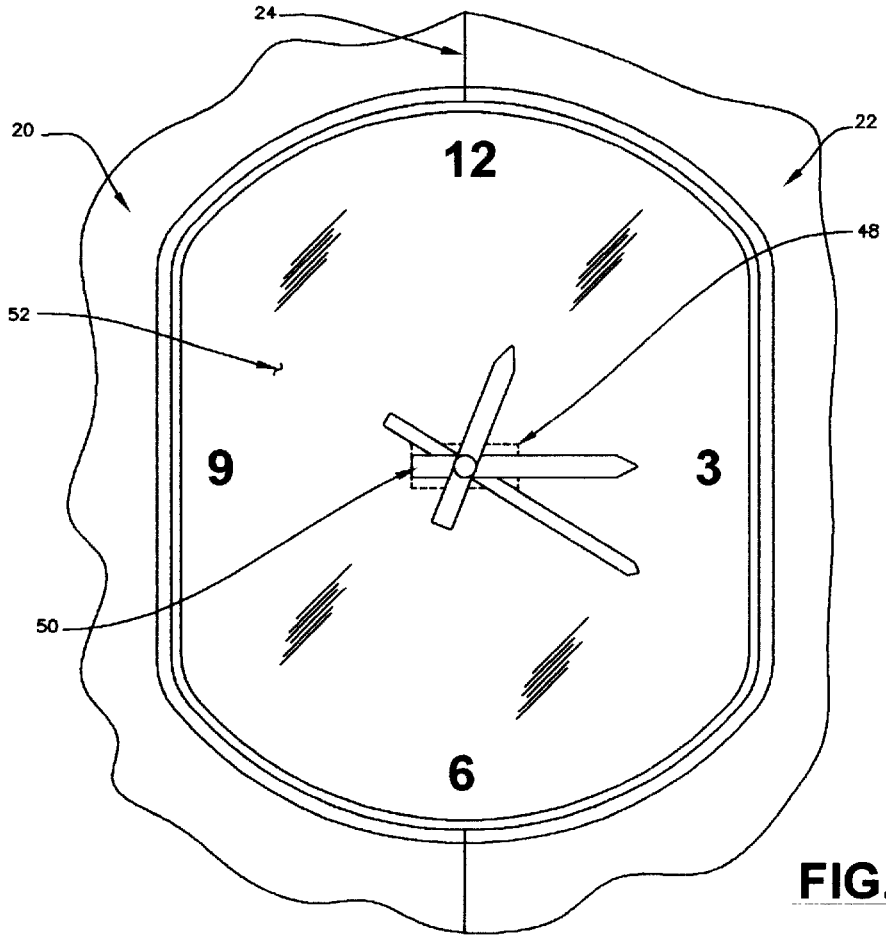
FIG. 2 is a front elevational view of the clock structure of the present invention with the corner wall structure shown partially.

The invention as a whole is shown in the drawings by reference character 10. Clock structure 10 includes as one of its elements a case 12, best shown in FIGS. 1 and 3. Case 12 includes a first wall 14 and a second wall 16. First wall 14 is angularly connected to second wall 16 at corner 18 by gluing, fasteners, integral formation, and the like. In any case, the angle between wall 14 and 16 closely matches the angle between corner walls 20 and 22 of an edifice. Walls 20 and 22 are formed by a series of studs and a wall covering such as gypsum board. Walls 20 and 22 form a corner 24, FIG. 2, which closely aligns with corner 18 of case 12.

Case 12 is also formed with short walls 26 and 28 that depend from case walls 14 and 16, respectively, in an angular direction. For example, wall 20 possesses a surface 30 which forms a recess 32 therewith. Likewise, a recess 34 is formed between wall 28 and surface 36 of wall 22. Purposes of recesses 32 and 34 will be fully described hereinafter. Case 12 further possesses top 25 and bottom 22, FIG. 1.

Structure 10 also is formed with a door 38 that is fixed to wall 36 by piano hinge 40. Door 38 also includes a spring latch 42 which interacts with strike 44 fixed to wall 28. Strike 34 and latch 42 lie within recess 34. The rear surface 46 of door 38 also supports a clock mechanism 48 of conventional configuration. Clock mechanism 48 operates hands 50 on face 52 of clock structure 10. Face 52 lies on one side 54 of door 38 opposite side or surface 46, thereof. Thus, recesses 32 and 34 serve to permit door 38 to open, directional arrow 55, and to latch by the interaction of latch 42 and strike 44 without interference. Such interference in a conventional clock would normally arise from prior configurations of case 12 or wall 20 or 22.

Figure 4:
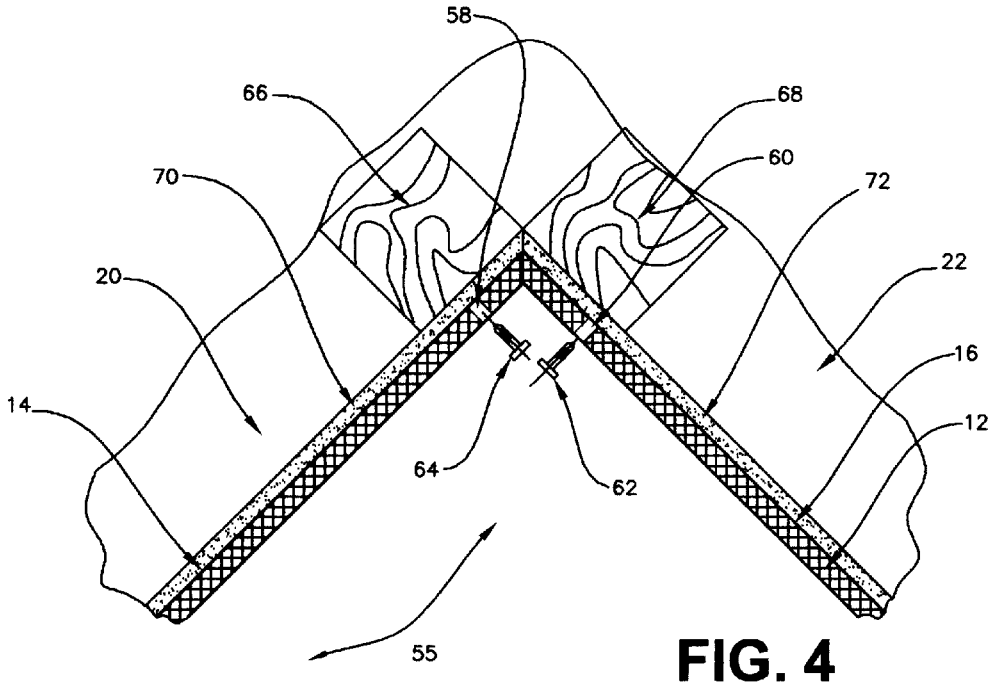
FIG. 4 is a sectional view taken along the line of the two upper openings depicted in FIG. 4 and depicting typical support structures for the corner walls in section.
Figure 3:
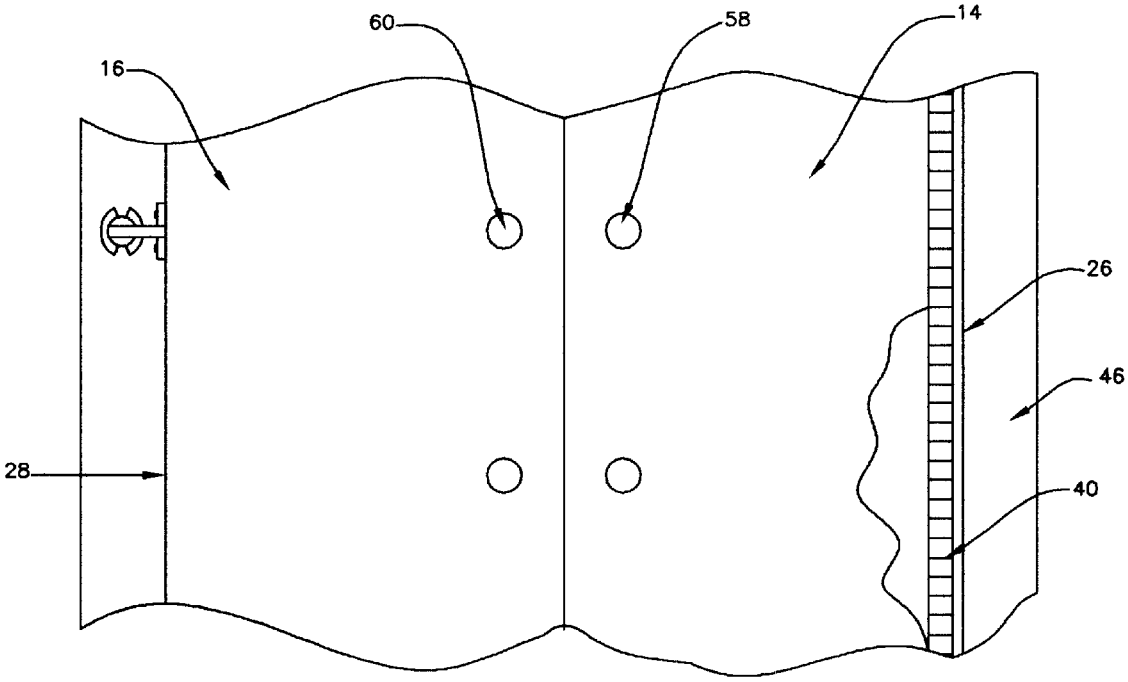
FIG. 3 is a partial rear elevational view of the clock structure of the present invention.

Means 56 is also included for fixing case 12 to walls 20 and 22 of the edifice. With reference to FIGS. 3 and 4, it may be observed that apertures or openings 58 through wall 14 and/or apertures 60 through wall 16 of case 12 permits the use of fasteners such as screws 62 and 64, FIG. 4 to secure case 12 to walls 20 and 22. Namely, screws 62 and 64 fasten directly into studs 66 and 68 which may be formed of wood or other solid material. Of course, screws 62 and 64 must pass through gypsum board layers 70 and 72 of walls 20 and 22, respectively. Thus, clock structure, including case 12 and door 38 is securely fastened to walls 20 and 22 at corner 24 thereof.

In operation, the user places case 12 against surfaces 30 and 36 of walls 20 and 22 and aligns outside corner 18 of case 12 with inside corner 24 formed by walls 20 and 22. Fasteners, such as screws 62 and 64, are placed through plurality of openings 58 and/or 60 to secure case 12 to walls 20 and 22. Door 38 of clock structure 10 is freely rotatable according to directional arrow 55. A portion of door 38 is capable of moving completely within recess 32 formed by walls 26 of case 12 and wall 20 of the edifice to permit such rotation. Likewise, latch 42 and strike 44 are engageable or disengageable within recess 34 without interference. The user would simply place his or her hand on door 38 in recess 34 and pull or push door 38 according to directional arrow 70 such movement would open or close door 38 to gain access to chamber 46 within case 12. Chamber 46 may be used for storage and houses time keeping mechanism 48 which is readily accessible for maintenance and repair.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A clock structure mountable to the connected first and second corner walls of an edifice, comprising:

a. a case, said case including a fist wall and a second wall, said first and second wall angularly affixed to each other to form a corner and closely match the orientation of the first and second corner walls of the edifice, said case further including a third wall connected to said first wall, said third case wall connected to said case first wall and extending outwardly from the first corner wall to form a first recess and said case further including a fourth wall, said fourth case wall connected to said case second wall and extending outwardly from the second corner wall to form a second recess;

b. a door, said door hingedly attached for rotation relative to said third case wall, a portion of said door extending into said first recess upon rotation of said door relative to said third case wall, said door and case forming a chamber; and c. a time keeping mechanism at least partially located in said chamber.

2. The structure of claim 1 which additionally comprises a clock face affixed to said door.

3. The structure of claim 2 in which said time keeping mechanism is fixed to said door within said chamber.

4. The structure of claim 3 which additionally comprises a latch mechanism, at least a portion of said latch mechanism affixed to said fourth case wall within said second recess, and a strike matable with said latch, said strike affixed to said door.

5. The structure of claim 1 which additionally comprises means for fixing said case selectively to the first and second corner walls of the edifice.

6. The structure of claim 5 which additionally comprises a clock face affixed to said door.

7. The structure of claim 6 in which said time keeping mechanism is fixed to said door within said chamber.

8. The structure of claim 7 which additionally comprises a latch mechanism, at least a portion of said latch mechanism affixed to said fourth case wall within said second recess, and a strike matable with said latch, said strike affixed to said door.

* * * * *